United States Patent [19]
Goldsberry et al.
[11] 4,307,679
[45] Dec. 29, 1981

[54] SUBMERGIBLE BARGE RETRIEVABLE STORAGE AND PERMANENT DISPOSAL SYSTEM FOR RADIOACTIVE WASTE

[75] Inventors: Fred L. Goldsberry, Spring, Tex.; William E. Cawley, Richland, Wash.

[73] Assignee: The United States of America as represented by the United States Department of Energy, Washington, D.C.

[21] Appl. No.: 106,203

[22] Filed: Dec. 21, 1979

[51] Int. Cl.[3] ..... B65D 88/78
[52] U.S. Cl. ..... 114/257; 114/26; 252/301.1 W; 405/128; 422/903
[58] Field of Search ..... 220/21, 411; 250/506, 250/507; 405/128; 114/256, 257, 26, 73, 74 A, 65 A, 52, 333

[56] References Cited

U.S. PATENT DOCUMENTS

| | | | |
|---|---|---|---|
| 3,046,403 | 7/1962 | Montgomery | 250/507 |
| 3,129,684 | 4/1964 | Cockrell | 114/74 A |
| 3,229,096 | 1/1966 | Bonilla et al. | 250/507 |
| 3,292,564 | 12/1966 | Lehmann | 114/333 |
| 3,324,814 | 6/1967 | Yee | 114/65 A |
| 3,659,543 | 5/1972 | Basile et al. | 114/74 A |
| 3,760,753 | 9/1973 | Mertens | 114/257 |

FOREIGN PATENT DOCUMENTS

| | | | |
|---|---|---|---|
| 2738109 | 3/1979 | Fed. Rep. of Germany | 252/301.1 W |
| 4510 | of 1883 | United Kingdom | 114/52 |

*Primary Examiner*—Sherman D. Basinger
*Attorney, Agent, or Firm*—Richard E. Constant; Robert Southworth; Richard G. Besha

[57] ABSTRACT

A submergible barge and process for submerging and storing radioactive waste material along a seabed. A submergible barge receives individual packages of radwaste within segregated cells. The cells are formed integrally within the barge, preferably surrounded by reinforced concrete. The cells are individually sealed by a concrete decking and by concrete hatch covers. Seawater may be vented into the cells for cooling, through an integral vent arrangement. The vent ducts may be attached to pumps when the barge is bouyant. The ducts are also arranged to promote passive ventilation of the cells when the barge is submerged. Packages of the radwaste are loaded into individual cells within the barge. The cells are then sealed and the barge is towed to the designated disposal-storage site. There, the individual cells are flooded and the barge will begin descent controlled by a powered submarine control device to the seabed storage site. The submerged barge will rest on the seabed permanently or until recovered by a submarine control device.

9 Claims, 7 Drawing Figures

SUBMERGIBLE BARGE RETRIEVABLE STORAGE AND PERMANENT DISPOSAL SYSTEM FOR RADIOACTIVE WASTE

BACKGROUND OF THE INVENTION

The present invention is related to the field of radioactive waste storage and disposal systems, and more particularly to sealed "radwaste" storage.

The problem of safely storing nuclear waste has been an ongoing problem since the first military and commercial use of nuclear waste producing devices. Increasing use of nuclear facilities has given rise to grave concerns as to where and how nuclear waste might be safely stored.

One of the prime concerns raised by the storage of nuclear waste arises from the fact that, to varying degrees, the half-life, of nuclear fission waste products can range into hundreds of years while artificially created transuranic elements can last hundreds of thousands of years. A safe storage site must not only be isolated from human contact but must also remain unaffected by natural phenomenon through extended periods of time.

The seabed has been used and is in current use for nuclear waste disposal sites. One prior seabed waste disposal technique was the process of packing nuclear waste within steel drums, filling them with cement, hauling the drums out to sea, and dumping the drums overboard at places where they were likely to sink directly to the seabed below.

The above method of waste disposal has serious drawbacks. The drums cannot be easily monitored. Also, the drums do not follow a controlled descent and may easily become lost along the seabed. Further, the drums are heavy and can sink deep into the bottom sediment, thereby decreasing the chances for subsequent recovery, even if they can be relocated.

Other forms of proposed seabed storage suggest the use of bore holes drilled in the ocean floor to receive packages of nuclear waste. This process obviates the location problem but, with it, gives rebirth to the fears of geologic stability that are presently of concern with underground storage. Furthermore, this type of storage would not be conducive to later recovery of the waste.

Relatively recent geological studies have confirmed the presence of areas along the floor of the Atlantic and Pacific Oceans that are devoid of life and, according to some studies, have been undisturbed for up to 70 million years. Such areas appear to be ideal as locations for storing or disposal of nuclear wastes. Such areas are clear from human contact and the ground surrounding them has proven stability. Their surrounding, relatively motionless water would provide natural cooling for the wastes.

The problem remains, however, of perfecting a method to safely move the waste material to the storage site, submerge it to the desired area of the seabed, and maintain the capability of later recovering the waste.

The present submergible barge and storage process allows for safe and reasonably economical storage of nuclear waste along the seabed within a submergible barge that can be towed to the site, submerged and controlled during descent to a selected seabed storage site. The barge includes segregated cells in which sealed waste containers are positioned. Ventilating ducts are formed integrally within the barge structure to enable passive ventilation, using seawater flowing naturally through the cells to cool the wastes sealed therein. The barge also includes recovery features that enable its selective resurfacing for recovery of the wastes.

SUMMARY OF THE INVENTION

A submergible barge and process is described for handling and storing radioactive wastes (radwaste). The barge includes a void to receive an impact resistant hull that supports a waste receiving storage tube. A deck covers the void and holds the storage tube secure and clear of the hull sides. Means is also provided in addition to the deck for sealing the tube within the hull. A vent allows coolant to be directed into the void and about the tube. The process disclosed involves placing the radwaste within a package, placing the package in a storage tube, sealing and cooling the tube within a barge, and subsequently floating the barge to a disposal site where it is submerged to the bottom surface.

It is a first object of the present invention to provide a radioactive waste storage and disposal system whereby radioactive wastes may be retrievably stored along the ocean bottom.

Another object is to provide such a system using the natural isolation, shielding, and dispersal mechanisms provided by the oceans, at a site substantially removed from the biosphere.

A further object is to provide such a system that will facilitate monitoring of the radwaste at its storage site.

A still further object is to provide such a system that may remain fully retrievable for hundreds of years with minimal recovery and transport expense.

A still further object is to provide such a system that provides for adequate cooling of stored radwaste during transport and while at the storage site.

DETAILED DESCRIPTION OF A PREFERRED EMBODIMENT

Figure 1:
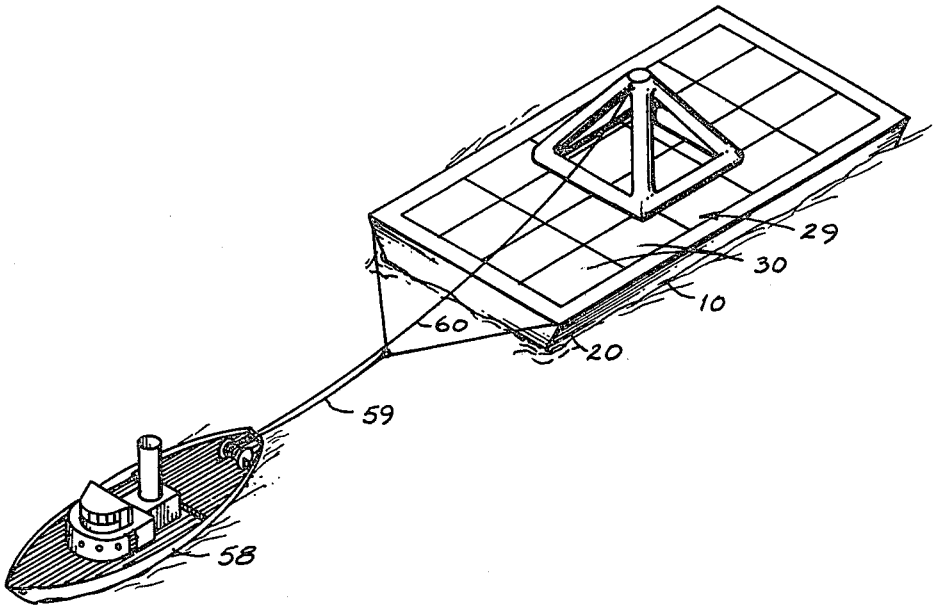
FIG. 1 is an isometric view of the present barge being towed behind a towing vessel.
Figure 2:
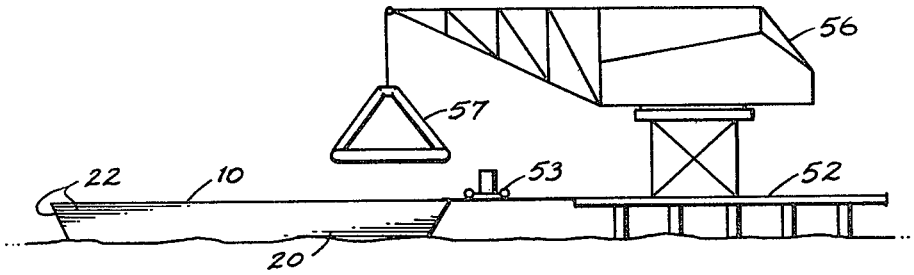
FIG. 2 is a diagrammatic view illustrating the barge being loaded.

The present invention relates to a submergible barge 10 and the method by which the submergible barge is loaded with radioactive waste packages 12, towed out to sea, and submerged to a selected storage site along the seabed 11.

The submergible barge 10 includes a relatively flat hull 20 preferably formed of steel-reinforced concrete. The hull 20 includes a bottom 21 and angularly inclined peripheral sides 22. The sides, like the remainder of the hull, are preferably formed of steel-reinforced concrete or other appropriate impact and radiation shielding material. It is intended that the sides 22 be designed with an impact safety factor at least capable of withstanding impact with an immovable concrete or steel piling at maximum towing speed.

Figure 7:
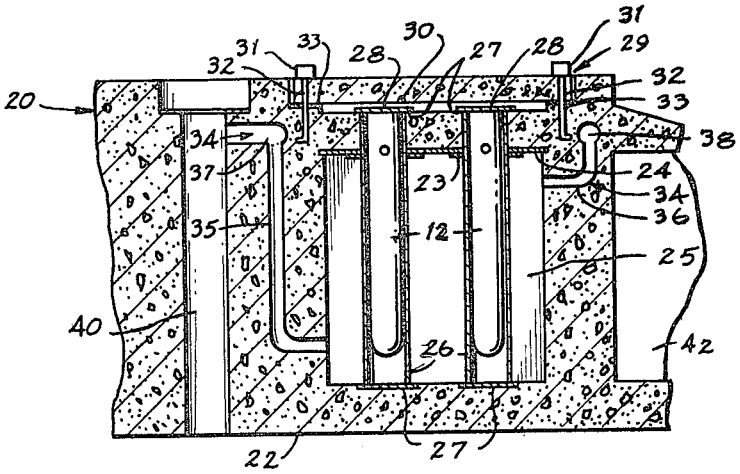
FIG. 7 is a sectional view taken through a single cell of the present barge.

The barge top is covered with a decking 23 (FIG. 7) that is formed integrally with the remainder of the hull and rests upon deck plates 24. The individual deck plates 24 cover a plurality of voids or cells 25 formed within the hull interior. Each cell 25 encloses one or more storage tubes 26 that are specifically designed for receiving and storing the "radwaste" packages 12.

The storage tubes 26 each include opposed flared ends 27. The bottom flared end will rest against the floor of a cell while the upper end extends above the deck plate 24. The deck 23, formed of reinforced concrete, is poured subsequent to positioning of the storage tubes within the individual cells. The storage tubes therefore become structurally integrated with the remainder of the rigid barge configurations. Each of the storage tubes 26 include a shield plug 28 covering the top surface.

A sealing means 29 is provided to seal the storage tubes 26 within the hull. Sealing means 29 may include a concrete hatch cover 30 for each of the cells 25. The hatch covers 30 may be removably secured to the hull by appropriate studs 32 and hatch cover nuts 31. The nuts may be selectively tightened on the threaded studs 32 to secure the hatch cover 30 downwardly against a sealing gasket 33. The nuts 31 enable selective removal of the hatch covers to allow quick, economical recovery of the waste material held within the individual cells 25.

The individual cells 25 are completely isolated within the hull with the exception that they are interconnected to a common ventilation means 34. It is preferred that the ventilation means 34 include individual ventilation intake ducts 35 and exhaust ducts 36. The ventilation intake ducts 35 lead from the individual cells to a common manifold duct 37. The exhaust ducts 36 lead into common manifold discharge ducts 38. Both manifolds 37 and 38 openly communicate with central upright vents 40 formed through the hull and opening on the top and bottom sides.

Figure 6:
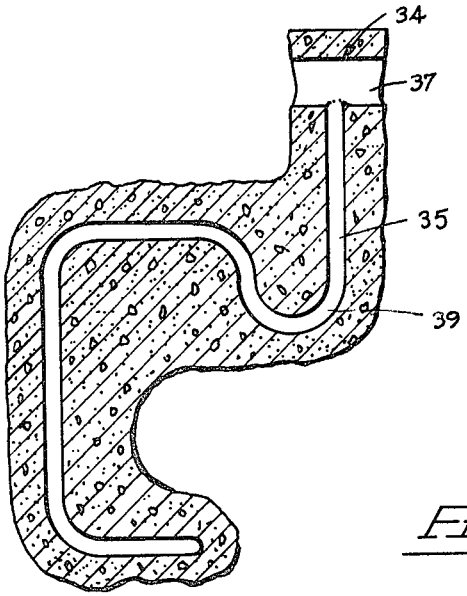
FIG. 6 is a fragmentary section view illustrating a ventilation duct and associated trap.

FIG. 6 shows the configuration of a single ventilation duct 35 opening into its common manifold duct 37. The intake duct 35 is formed integrally within the concrete of the hull structure. It is preferred that the duct 35 (as well as the exhaust ducts 36) be formed in a tortuous configuration, forming a trap 39 to prevent radiation "shine" into the manifold ducts.

The cells within the hull 20 may be surrounded by empty impact and flotation cells 42. Such cells extend about the hull perimeter directly adjacent to the rigid sides 22. The air space included within the cells 42 can be selectively vented by appropriate valve mechanisms (not shown) which facilitate filling of the cells with water to produce negative buoyancy of the hull and allow it to be submerged.

The present process includes as a first step, the loading of the package 12 into the individual storage tubes 26. This is done at a loading dock 52 utilizing standard packing and loading devices such as a bottom loading shielded fuel handling machine diagrammatically shown at 53. The individual packages 12 are moved into position over the upwardly open storage tubes 26. Packages are then lowered into the storage tubes and the shield plugs 28 are secured in place. At this time or previously the deck 23 has been poured over the rigid deck plates 24 up to the level of the upper flared storage tube ends 27. The deck 23 therefore becomes an integral part of the hull 20. In addition, the storage tubes 26 become structural components of the entire deck, extending as support columns between the hull bottom 21 and the deck 23.

The hatch covers 30 may be put into place after the shield plugs 28 have been appropriately secured to seal the storage tubes 26. Gaskets are placed about the deck adjacent to the points of engagement by the hatch cover. The hatch covers are then lowered over upwardly projecting studs 32. Hatch cover nuts 31 are then threadably secured on the studs 32 and tightened against the hatch cover 30, pressing it securely against the deck 23.

When each of the cells have been filled and sealed, a loading crane 56 may be utilized to hoist a control submarine onto the barge top. The control submarine will preferably communicate with the common vertical vents 40 which connect to the individual cells 25 through their ventilation ducts. The control submarine 57 can therefore function to circulate a cooling fluid (preferably seawater) through the cells to cool the radwaste packages 12 during the trip to the selected seabed storage area. The control submarine 57 may include appropriate apparatus that will facilitate submerging of the barge by completely filling the cells 25 and peripheral cells with seawater.

The control submarine 57 and barge 10 are towed to sea by an appropriate towing vessel such as the tug shown at 58 in FIG. 1. A releasable tow line 59 extends between the tug and the barge. The tug will pull the floating barge 10 to its destination over the selected seabed area. During this time, appropriate pumps within the control submarine 57 may be operating continuously to circulate cooling fluid through the cells 25 to maintain safe temperatures of the radwaste packages.

Figure 3:
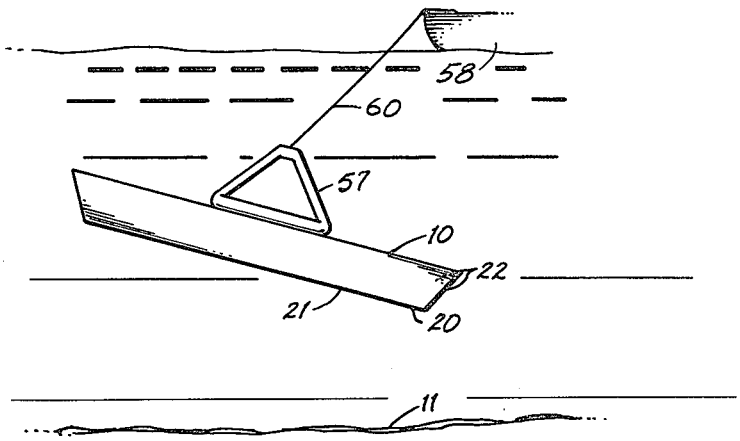
FIG. 3 is a diagrammatic view illustrating placement of the barge along the seabed by a submarine control device.
Figure 4:
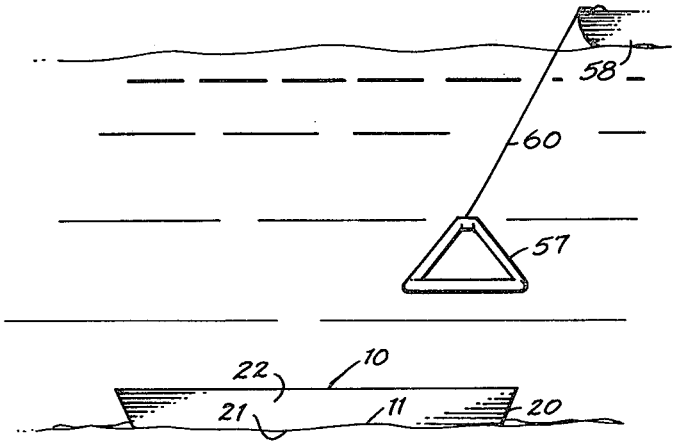
FIG. 4 is a diagrammatic view illustrating return of the submarine control device to the towing vessel.
Figure 5:
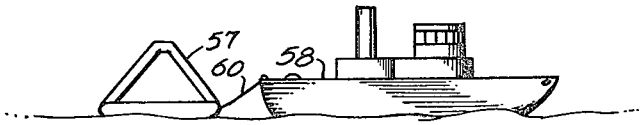
FIG. 5 illustrates towing of the submarine control device back to the loading dock.

As the tug 58 arrives with the barge at the selected site, the tow line 59 is dropped, and appropriate apparatus is operated to flood the cells to impart negative buoyancy of the barge. The barge will then submerge as shown in FIG. 3. The submarine 57 may include appropriate propulsion devices that will enable selective positioning of the barge as it descends to its selected storage spot along the seabed. Such control may be maintained by attendants within the control submarine 57 or along a control line 60 extending between the tug 58 and submarine 57.

When the barge is appropriately located along the bottom, the submarine is detached to float or be lifted to the surface where it may be returned to the loading dock to the next successive barge.

Disconnection of the submarine 57 from the hull 20 leaves the vertical ventilators 40 open to the seawater. Water can therefore be circulated by natural convection through the manifolds and intake and exhaust ducts. Passive cooling of the radwaste packages is therefore assured.

At some later point in time, it may become desirable to recover the radwaste packages for further processing. The present barge is specifically designed for ease in recovery. The process simply involves submerging the control submarine 57 to the barge hull 20 and attaching the submarine to the hull. The submarine may include apparatus that will purge the seawater from the individual cells, thereby producing positive buoyancy within the barge. Resistance to resurfacing of the barge due to bottom suction is avoided through the vertical vents 40 which may direct downward thrusts of air or water between the seabed and barge bottom. The resurfaced barge can then be towed back to an appropriate area where the radwaste packages may be removed. Removal is accomplished simply by removing the hatch cover nuts 31 and lifting the hatch cover from the associated cell. The exposed shield plugs can thereafter be removed to allow free access to the packages 12.

The advantages of the present barge and the associated method for storing nuclear waste material are many. First, the present system supplies triple containment for nuclear waste. The wall of the radwaste package 12 is the first barrier, the storage tube is the second barrier, and the concrete cell wall becomes the third barrier by use of the hatch cover and appropriate valves on the vent tubes (during transit). Appropriate bends are incorporated into the vent tubes to prevent radiation shine.

Cellular construction is utilized throughout the barge. Perimeter cells may provide collision protection while all cells can be used for ballast. The barge may therefore be safely towed along the surface of the ocean without danger of being sunk at an undesirable location or destroyed by collision.

The barge may be submerged at a site to make use of natural isolation, shielding, and dispersal mechanisms. Such areas, as the desolate, ocean deserts, are effectively removed from the biosphere.

Another distinct advantage is that design parameters are known and well understood. The number of variables associated with the pathways to man are distinctly more definable than through the ground surface or through the atmosphere.

Another distinct advantage is that barge costs will be comparable to water basin and dry surface storage and less than geologic or single package seabed disposal.

Design of the barge and storage tubes, along with the radwaste packages 12 may be such that the barge will remain recoverable for a several hundred year period. Furthermore, the lack of mechanical control apparatus mounted directly to the barge along with the passive ventilation system assures that no mechanical failure can occur during the storage period that would lead to the waste heating and damaging containment packages. This danger is further avoided by actual construction of the radwaste package which may include a borosilicate glass bead filler to provide: poison for radioactive material; crust resistance to the package; a good heat transfer medium; survival until dissolution of the radioactive waste in the ocean environment has been completed; and negative buoyancy for the package.

It should be noted that the above description is given merely by way of example to describe a preferred form of the present invention.

What is claimed is:

1. A radioactive waste handling process, comprising the steps of:

(a) situating a storage tube within a void within a barge hull and out of contact with the hull sides and surrounded with shielding and structural material;

(b) placing radioactive waste within a sealed waste package;

(c) placing the waste package within the storage tube;

(d) sealing the storage tube;

(e) cooling the storage tube by circulating a coolant fluid about the storage tube;

(f) floating the barge hull along a body of water to a position over a disposal site; and (g) submerging the barge from the water surface to the bottom surface at the disposal site.

2. A radioactive waste handling process, as set out by claim 1, wherein the step of cooling the storage tube is accomplished by pumping water from the body of water into contact with the storage tube.

3. A radioactive waste handling process as set out by claim 1 wherein the step of submerging the barge is accomplished by filling the barge hull with water and by actively guiding the hull downwardly to the disposal site.

4. The process of claim 3 wherein the step of cooling the storage tube is accomplished by venting the void within the hull by pumping water through the void from said body of water.

5. A radioactive waste handling process as set out by claim 1 wherein the step of submerging the barge is done by filling the space between the storage tube and the barge hull with water; attaching the hull to a guidance submarine and operating the submarine to actively guide the hull downwardly to the disposal site.

6. The process of claim 1 comprising the further step of pouring a concrete deck across the hull over the void and wherein the step of sealing the storage tube is accomplished by affixing a hatch cover over the concrete deck to cover the storage tube and deck.

7. A submergible barge for storing radioactive waste, comprising:

a hollow hull having peripheral sides of impact shielding material;

a storage tube within a void in the hull adapted to receive radioactive waste;

a deck means extending between the hull sides for covering the void within the hull adjacent the storage tube and for holding the storage tube secure within the void clear of the peripheral hull sides;

means for sealing the storage tube within the hull;

vent means leading into the void for selectively receiving and directing a coolant fluid into the void; and means for submerging the barge in water; and wherein the vent means includes two hollow vent ducts formed through the hull having inner ends opening into the void at vertical spaced locations, and outer ends opening into the water when the barge is submerged to facilitate passive circulation of water through the void.

8. A submergible barge for storing radioactive waste, comprising:

a hollow hull having peripheral sides of impact shielding material;

a storage tube within a void in the hull adapted to receive radioactive waste;

a deck means extending between the hull sides for covering the void within the hull adjacent the storage tube and for holding the storage tube secure within the void clear of the peripheral hull sides;

means for sealing the storage tube within the hull;

vent means leading into the void for selectively receiving and directing a coolant fluid into the void; and means for submerging the barge in water; wherein the hull is compartmented into a plurality of cells, with each cell defining a void and receiving a storage tube; and wherein the vent means includes a manifold duct opening into individual ventilation ducts that openly communicate with the cell voids.

9. A submergible barge for storing radioactive waste, comprising;

a hollow hull having peripheral sides of impact shielding material and being compartmented into a plurality of cells each defining a void;

a storage tube adapted to receive radioactive waste upright and centered within each void;

the hull including a flat bottom, upwardly projecting sides, and a deck extending between the hull sides for covering the voids adjacent the storage tubes secure within the voids clear of the sides;

a shield plug received within an upper end of each storage tube sealing the radioactive waste within the tube;

a hatch cover for sealing each storage tube extending over the deck and secured to the hull;

means for selectively submerging and resurfacing the barge in a body of water; and vent means leading into the voids for selectively receiving water from the body of water and directing the water into the voids, wherein said vent means comprise a manifold duct opening into individual ventilation ducts that openly communicate with the voids, wherein the ventilation ducts have a series of bends to prevent radiation shine, and wherein said ventilation ducts are in communication with a vertical vent to allow passive cooling while submerged and to break bottom suction during barge resurfacing.

* * * * *